US012584305B2

(12) United States Patent
Douglass

(10) Patent No.: US 12,584,305 B2
(45) Date of Patent: Mar. 24, 2026

(54) LOW PROFILE ASYMMETRIC LEACHING CHAMBER FOR ONSITE WASTEWATER MANAGEMENT SYSTEM

(71) Applicant: Prinsco, Inc., Willmar, MN (US)

(72) Inventor: Brian L. Douglass, Willmar, MN (US)

(73) Assignee: Prinsco, Inc., Willmar, MN (US)

( * ) Notice: Subject to any disclaimer, the term of this patent is extended or adjusted under 35 U.S.C. 154(b) by 72 days.

(21) Appl. No.: 18/791,915

(22) Filed: Aug. 1, 2024

(65) Prior Publication Data

US 2026/0035903 A1 Feb. 5, 2026

(51) Int. Cl.
*E03F 1/00* (2006.01)
*E03F 11/00* (2006.01)

(52) U.S. Cl.
CPC ..... *E03F 11/00* (2013.01)

(58) Field of Classification Search
CPC . E03F 1/003; E03F 1/002; E03F 1/005; E03F 5/10; E03F 11/00; E02B 11/005
See application file for complete search history.

(56) References Cited

U.S. PATENT DOCUMENTS 2,153,789 A 4/1939 F. L. et al.
2,834,087 A * 5/1958 Albert ..... F16L 23/10 24/279
3,495,410 A 2/1970 W. A. et al.
3,648,468 A 3/1972 Bowers
4,245,924 A 1/1981 Fouss et al.
4,254,885 A 3/1981 Fouss et al.
4,286,808 A 9/1981 Fouss et al.
4,357,190 A 11/1982 Fouss et al.
4,359,167 A 11/1982 Fouss et al.
4,360,042 A 11/1982 Fouss et al.
4,363,732 A 12/1982 Crates et al.
4,374,079 A 2/1983 Fouss et al.
4,523,613 A 6/1985 Fouss et al.
4,527,319 A 7/1985 Rosenbaum et al.
RE32,312 E 12/1986 Crates et al.
4,709,723 A 12/1987 Sidaway et al.
4,759,661 A 7/1988 Nichols et al.
5,017,041 A 5/1991 Nichols
5,087,151 A 2/1992 DiTullio
(Continued)

OTHER PUBLICATIONS

Prinsco Pro4 Onsite Chamber. Catalogue [Online]. prinsco.com 2023. [Retrieved on Jul. 12, 2023]. Retrieved from the Internet: <URL:https://www.prinsco.com/prinsco-markets/products/pro4/> (Year: 2023).

(Continued)

*Primary Examiner* — Benjamin F Fiorello
(74) *Attorney, Agent, or Firm* — Schroeder & Siegfried, P.A.

(57) ABSTRACT

A low-profile arch-shaped wastewater leaching chamber having asymmetric corrugations running transversely along the length of the chamber, where each corrugation has a wide section with a straight sidewall on one side, a substantially flat top portion, and a tapering downward extending curved section on the opposed side of the chamber. Each corrugation is reversed in orientation and transversely offset relative to adjacent corrugations, such that the curved tapering section of each corrugation is significantly inset from adjacent wide sections toward the center of the chamber body.

22 Claims, 9 Drawing Sheets

(56) References Cited

U.S. PATENT DOCUMENTS

| | | | |
|---|---|---|---|
| D329,684 | S | 9/1992 | Gray |
| 5,156,488 | A | 10/1992 | Nichols |
| 5,336,017 | A | 8/1994 | Nichols |
| 5,401,116 | A | 3/1995 | Nichols |
| 5,401,459 | A | 3/1995 | Nichols et al. |
| 5,419,838 | A | 5/1995 | DiTullio |
| 5,441,363 | A | 8/1995 | Gray |
| 5,498,104 | A | 3/1996 | Gray |
| 5,511,903 | A | 4/1996 | Nichols et al. |
| 5,556,231 | A | 9/1996 | Sidaway et al. |
| 5,588,778 | A | 12/1996 | Nichols et al. |
| 5,669,733 | A | 9/1997 | Daly et al. |
| 5,716,163 | A | 2/1998 | Nichols et al. |
| 5,773,756 | A | 6/1998 | DiTullio |
| 5,839,844 | A | 11/1998 | Nichols et al. |
| D403,047 | S | 12/1998 | Gray |
| 5,890,838 | A | 4/1999 | Moore, Jr. et al. |
| 6,018,909 | A | 2/2000 | Potts |
| 6,076,993 | A | 6/2000 | Gray |
| 6,129,482 | A | 10/2000 | DiTullio |
| 6,270,287 | B1 | 8/2001 | Gray |
| 6,322,288 | B1 | 11/2001 | DiTullio |
| 6,361,248 | B1 | 3/2002 | Maestro |
| 6,375,388 | B1 | 4/2002 | Zoeller et al. |
| 6,443,652 | B1 | 9/2002 | Houch et al. |
| 6,485,647 | B1 | 11/2002 | Potts |
| D469,187 | S | 1/2003 | Maestro |
| D474,524 | S | 5/2003 | Benecke |
| D474,525 | S | 5/2003 | Benecke |
| D477,381 | S | 7/2003 | Benecke |
| 6,592,293 | B1 | 7/2003 | Hedstrom et al. |
| 6,602,023 | B2 | 8/2003 | Crescenzi et al. |
| 6,612,777 | B2 | 9/2003 | Maestro |
| 6,679,653 | B1 | 1/2004 | DiTullio |
| 6,680,011 | B2 | 1/2004 | Moore, Jr. et al. |
| 6,698,975 | B1 | 3/2004 | Benecke |
| 6,719,490 | B2 | 4/2004 | Maestro |
| 6,783,683 | B2 | 8/2004 | Collings |
| 6,814,863 | B2 | 11/2004 | Hallahan et al. |
| 6,854,925 | B2 | 2/2005 | DiTullio |
| 6,887,383 | B2 | 5/2005 | Potts |
| 6,907,997 | B2 | 6/2005 | Thacker et al. |
| 6,923,905 | B2 | 8/2005 | Potts |
| 6,969,464 | B1 | 11/2005 | Potts |
| 6,991,734 | B1 | 1/2006 | Smith et al. |
| 6,994,355 | B2 | 2/2006 | Brochu et al. |
| 7,004,221 | B2 | 2/2006 | Moore, Jr. et al. |
| 7,008,138 | B2 | 3/2006 | Burnes et al. |
| 7,033,496 | B2 | 4/2006 | Thacker et al. |
| 7,052,209 | B1 | 5/2006 | Kruger et al. |
| 7,118,306 | B2 | 10/2006 | Kruger et al. |
| 7,160,059 | B2 | 1/2007 | Hedstrom et al. |
| D537,912 | S | 3/2007 | Benecke |
| D538,387 | S | 3/2007 | Benecke |
| D538,388 | S | 3/2007 | Benecke |
| D538,882 | S | 3/2007 | Benecke |
| 7,189,027 | B2 | 3/2007 | Brochu et al. |
| 7,207,747 | B1 | 4/2007 | Englad |
| 7,217,063 | B2 | 5/2007 | Moore, Jr. et al. |
| 7,226,241 | B2 | 6/2007 | DiTullio |
| 7,237,981 | B1 | 7/2007 | Vitarelli |
| 7,273,330 | B1 | 9/2007 | Brochu et al. |
| 7,306,399 | B1 | 12/2007 | Smith |
| 7,306,400 | B1 | 12/2007 | Brochu et al. |
| 7,309,434 | B2 | 12/2007 | Potts |
| 7,311,467 | B2 | 12/2007 | Moore, Jr. |
| 7,351,005 | B2 | 4/2008 | Potts |
| 7,351,006 | B2 | 4/2008 | Burnes et al. |
| 7,364,384 | B1 | 4/2008 | Swistak |
| 7,374,670 | B2 | 5/2008 | Potts |
| 7,396,188 | B2 | 7/2008 | Brochu et al. |
| 7,413,382 | B2 | 8/2008 | Hedstrom et al. |
| 7,419,331 | B2 | 9/2008 | Brochu et al. |
| 7,419,332 | B1 | 9/2008 | Brochu et al. |
| 7,451,784 | B2 | 11/2008 | Goddard |
| 7,465,122 | B2 | 12/2008 | Brochu et al. |
| 7,465,390 | B2 | 12/2008 | Potts |
| 7,473,053 | B1 | 1/2009 | Brochu et al. |
| 7,491,015 | B2 | 2/2009 | Coppes et al. |
| 7,500,805 | B1 | 3/2009 | Brochu et al. |
| 7,517,172 | B2 | 4/2009 | Sipaila |
| 7,585,130 | B2 | 9/2009 | Swistak et al. |
| 7,611,306 | B1 | 11/2009 | Hallahan et al. |
| 7,632,447 | B2 | 12/2009 | Swistak et al. |
| 7,637,691 | B1 | 12/2009 | DiTullio |
| D613,819 | S | 4/2010 | DiTullio |
| 7,744,759 | B1 | 6/2010 | Potts |
| 7,806,627 | B2 | 10/2010 | DiTullio |
| 7,841,801 | B2 | 11/2010 | Burnes |
| D630,294 | S | 1/2011 | Hardesty et al. |
| 7,887,256 | B2 | 2/2011 | Miskovich |
| 7,914,230 | B2 | 3/2011 | Moore, Jr. et al. |
| 7,914,231 | B2 | 3/2011 | Coppes et al. |
| D638,094 | S | 5/2011 | DiTullio |
| D638,095 | S | 5/2011 | DiTullio |
| 8,002,497 | B2 | 8/2011 | Hedstrom et al. |
| 8,070,005 | B1 | 12/2011 | Kruger et al. |
| 8,147,688 | B2 | 4/2012 | Adams et al. |
| 8,151,999 | B1 | 4/2012 | Moore, Jr. et al. |
| 8,256,990 | B2 | 9/2012 | Koerner |
| D668,318 | S | 10/2012 | DiTullio |
| 8,297,880 | B2 | 10/2012 | Brochu et al. |
| 8,322,948 | B2 | 12/2012 | Moore, Jr. et al. |
| 8,337,119 | B2 | 12/2012 | Burnes et al. |
| 8,366,346 | B2 | 2/2013 | DiTullio |
| 8,414,222 | B2 | 4/2013 | DiTullio |
| 8,425,147 | B2 | 4/2013 | Cislo et al. |
| 8,425,148 | B2 | 4/2013 | DiTullio |
| 8,491,224 | B2 | 7/2013 | Cobb et al. |
| 8,550,807 | B2 | 10/2013 | Kolbet |
| 8,579,624 | B2 | 11/2013 | Sutton et al. |
| 8,617,390 | B2 | 12/2013 | Potts |
| 8,672,583 | B1 | 3/2014 | Mailhot et al. |
| 8,740,005 | B1 | 6/2014 | Holbrook et al. |
| 8,789,714 | B1 | 7/2014 | Kruger et al. |
| 8,801,326 | B2 | 8/2014 | Coppes et al. |
| 8,857,641 | B1 | 10/2014 | Moore, Jr. et al. |
| 9,016,979 | B1 | 4/2015 | Coppes et al. |
| 9,045,873 | B1 | 6/2015 | Moore, Jr. |
| D737,927 | S | 9/2015 | DiTullio |
| 9,174,863 | B2 | 11/2015 | Potts |
| 9,233,775 | B1 | 1/2016 | Holbrook et al. |
| 9,255,394 | B2 | 2/2016 | Mailhot et al. |
| 9,260,854 | B1 | 2/2016 | Moore, Jr. et al. |
| 9,273,440 | B1 | 3/2016 | Moore, Jr. et al. |
| D753,262 | S | 4/2016 | DiTullio |
| 9,365,993 | B1 | 6/2016 | Moore, Jr. et al. |
| 9,403,692 | B2 | 8/2016 | Potts |
| 9,556,576 | B2 | 1/2017 | Mailhot et al. |
| 9,637,907 | B2 | 5/2017 | Mailhot et al. |
| 9,650,271 | B2 | 5/2017 | Potts |
| 9,656,892 | B2 | 5/2017 | Potts |
| 9,670,660 | B1 | 6/2017 | Moore, Jr. et al. |
| D791,272 | S | 7/2017 | DiTullio |
| D792,552 | S | 7/2017 | DiTullio |
| 9,752,312 | B2 | 9/2017 | Holbrook et al. |
| 9,765,509 | B1 | 9/2017 | DiTullio |
| 9,809,968 | B1 | 11/2017 | Holbrook et al. |
| 9,840,040 | B2 | 12/2017 | Moore, Jr. et al. |
| 9,850,647 | B1 | 12/2017 | Coppes et al. |
| 9,850,648 | B1 | 12/2017 | DiTullio |
| D806,827 | S | 1/2018 | Mailhot et al. |
| 9,885,171 | B2 | 2/2018 | Mailhot et al. |
| 9,889,986 | B2 | 2/2018 | Holbrook et al. |
| 9,982,425 | B2 | 5/2018 | Vitarelli et al. |
| D820,384 | S | 6/2018 | DiTullio |
| 10,065,875 | B2 | 9/2018 | Potts |
| D832,393 | S | 10/2018 | DiTullio et al. |
| 10,179,989 | B2 | 1/2019 | DiTullio |
| D840,499 | S | 2/2019 | DiTullio et al. |
| 10,472,813 | B1 | 11/2019 | Sipaila |
| 10,544,575 | B1 | 1/2020 | DiTullio |
| 10,837,164 | B1 | 11/2020 | Potts |
| 11,028,569 | B2 | 6/2021 | Spires et al. |

(56) References Cited

U.S. PATENT DOCUMENTS

| | | | |
|---|---|---|---|
| 11,795,679 | B2 | 10/2023 | Douglass |
| D1,036,616 | S | 7/2024 | Douglass |
| D1,036,617 | S | 7/2024 | Jemming et al. |
| 2006/0012166 | A1 | 1/2006 | Siferd et al. |
| 2007/0077122 | A1 | 4/2007 | Birchler et al. |
| 2007/0081860 | A1 | 4/2007 | Goddard et al. |
| 2008/0187399 | A1 | 8/2008 | Suazo |
| 2010/0329788 | A1 | 12/2010 | Moore, Jr. |
| 2010/0329789 | A1 | 12/2010 | Coppes et al. |
| 2011/0020065 | A1 | 1/2011 | Moore, Jr. et al. |
| 2011/0200391 | A1 | 8/2011 | Mailhot et al. |
| 2011/0293370 | A1 | 12/2011 | Moore, Jr et al. |
| 2013/0075315 | A1 | 3/2013 | Potts |
| 2016/0084406 | A1 | 3/2016 | Potts et al. |
| 2016/0186423 | A1 | 6/2016 | Coppes et al. |
| 2016/0326033 | A1 | 11/2016 | Potts |
| 2017/0191251 | A1 | 7/2017 | Trude et al. |
| 2018/0044905 | A1 | 2/2018 | Potts et al. |
| 2018/0087258 | A1 | 3/2018 | Holbrook et al. |
| 2018/0238039 | A1 | 8/2018 | Vitarelli et al. |
| 2018/0319686 | A1 | 11/2018 | Potts et al. |
| 2023/0012614 | A1 | 1/2023 | Douglass |
| 2023/0257986 | A1 | 8/2023 | Douglass et al. |

OTHER PUBLICATIONS

Prinsco Pro4 Onsite Chamber. Datasheet[Online[. prinsco.com 2022. [Published on Jul. 12, 2022] [Retrieved onJul. 12, 2023]. Retrieved from the Internet: <URL:https://www.prinsco.com/wp-content/uploads/2022/07/Prinsco-Pro4-36-CompSheet_Broad-Market_v1_062122.pdf> (Year:2022).

Dobbins, Tim. Product Spotlight . . . Onsite Chamber System. Onsie Installer. Sep. 2022 [Online]. [Retrieved on Jul. 12, 2023]. Retrieved from the Internet: <URL:https://www.onsiteinstaller.com/editorial/2022/09/product-spotlight-customers-prompted-the-feature-set-of-new-pro4-onsite-chamber-system> (Year: 2022).

Design U.S. Appl. No. 29/827,094, Septic Chamber, filed Feb. 17, 2022, Inventor Brian L. Douglass.

Design U.S. Appl. No. 29/925,192, Septic Chamber Body, filed Jan. 23, 2024, Inventor Brian L. Douglass.

Design U.S. Appl. No. 29/925,197, Septic Chamber, filed Jan. 23, 2024, Inventor Brian L. Douglass.

* cited by examiner

LOW PROFILE ASYMMETRIC LEACHING CHAMBER FOR ONSITE WASTEWATER MANAGEMENT SYSTEM

FIELD OF INVENTION

The present invention relates generally to the art of wastewater management systems, and more particularly to the construction of an improved leaching chamber design for onsite wastewater management systems having a low-profile asymmetrical corrugation configuration running transversely along the length of the chamber, where each transverse corrugation has a wide section on one side, a narrow section on the opposed side of the chamber, and a substantially flat top section.

BACKGROUND

The statements in this section merely provide background information related to the present disclosure and may not constitute prior art.

Decentralized on-site septic systems are used to sustainably manage and treat sanitary waste streams from residences, commercial, industrial, and communal sites. Onsite septic systems are comprised of a conveyance pipe connecting the house plumbing to one or two underground septic tanks which are then connected to a series of laterals comprised of pipes or chambers to allow for effluent treatment and dispersion into the soil. The purpose of the laterals is to provide maximum contact with surrounding soil to promote biological activity to breakdown and treat the effluent. While pipe systems perform reasonably well, open bottom chambers have proven more effective due to the significant increase in underground soil contact area which enables more treatment per unit of length of the system. Whether the laterals are comprised of pipe or chambers, they are commonly 20 feet to hundreds of feet long, requiring several chambers or pipe connected together.

To maximize chamber effectiveness, the bottom must be open and the sidewalls designed to promote maximum transfer of effluent through the walls without permitting soil infiltration. Further, these chambers must accommodate handling and installation forces as well as earth and vehicle loads such as AASHTO H-10 truckloads.

Traditionally, chambers are designed with corrugations running transverse and perpendicular to the length and chambers may include structural columns to support the traffic and earth loads. Typically, there are louver sections on the side of the chamber in the valleys and the peaks of the corrugations to maximize the soil contact area. Stiffeners are added lengthwise to increase the stiffness of the chamber for handling and installation.

The extensive louver sections located along the side of the chamber in the corrugation peaks and sometimes valleys result in reduced structural capacity and can require additional stiffening by way of structural columns. Columns and other structural reinforcements add weight, and complicate stacking and handling, as well as manufacturing.

While some advancements in the art have met with reasonable success, additional problems have been presented. For instance, "continuous curve" cross-sectional shape chambers have been advocated, but such chambers present additional difficulties. Decreasing chamber span-width to maximize stiffness to weight ratio results in sharper crown pitch angles, thus making maneuverability for installers across the chamber crown more difficult and time consuming. Increasing chamber span-width, however, often requires the use of strengthening ribs or columns for support, which increase cost and weight. Still further, the transverse corrugations of such chambers are typically aligned perpendicular to the length of the chamber, thus limiting longitudinal stiffness of the chamber, i.e., "slinky" effect.

More recently, the present Applicant has developed a leaching chamber design for onsite wastewater management systems which incorporates a series of asymmetric corrugations running transversely along the length of the chamber. The corrugations of this chamber are designed to have large louvered sidewall sections on one side for maximizing effluent transfer to the surrounding soil, with opposed tail sections which curve downward and taper inwardly to create transverse corrugation walls extending angularly relative to the chamber longitudinal axis. This largely eliminates the "slinky" effect of conventional leaching chambers and greatly enhances the structural integrity of the chamber as a whole. This leaching chamber is the subject of U.S. Pat. No. 11,795,679, entitled: Asymmetric Leaching Chamber for Onsite Wastewater Management System.

While the foregoing chambers are adequate for many purposes, there are other applications where installation of shallow onsite wastewater systems are more desirable or necessary. In high water table areas and sites having limited access, installation may be restricted to only 4 to 24 inches below grade. In such cases, standard mound systems with conventional leaching chambers requiring greater excavation, more fill, and larger equipment are typically not desirable or useful. In these situations, leaching chambers with lower profiles can be useful. However, altering the profile of the leaching chamber does present additional issues of structural integrity which can be challenging. Flattening the chamber to create a lower profile reduces the structural load capacity of the chamber, which is only further exacerbated if the chamber width is increased to compensate for loss of chamber storage capacity. This loss in structural load capacity consequently leads to a need for an additional support system to enhance the strength of the chamber.

One known low profile leaching chamber of this type is the Quick4® Plus Standard Low-Profile chamber manufactured by Infiltrator Water Technologies, LLC. This chamber has a relatively low (~8") flat profile and incorporates a series of integrally formed central columns which extend downward within the chamber interior to provide added support and load capacity. Here again, however, there is added cost in material and weight, and such columns negatively impact the overall storage capacity of the chamber system. Therefore, it is evident that there is still a distinct need for improvement in this segment of the industry.

SUMMARY

One object of the present invention is to provide a leaching chamber for onsite wastewater management systems having a relatively low profile which provides sufficient chamber span-width and storage capacity without requiring interior support columns. Another object is to maintain available footprint on the chamber crown without sacrificing load strength. Still another object of the present invention is to provide a chamber corrugation profile which increases longitudinal stiffness of the chamber. Still further, it is an object of the present invention to provide a chamber with sidewalls having an increased stiffness to weight ratio, while maximizing louver area for greater effluent to soil contact area. It is also an object to accomplish the forgoing with a chamber that provides a reduced cost per unit of leaching area.

In furtherance of the foregoing objectives, the present invention incorporates a novel approach to low profile septic leaching chambers used in onsite wastewater management systems, which offers a high degree of bottom and sidewall leaching area while not requiring supporting columns and extra stiffening features. Similar to Applicant's previous asymmetric chamber designs, the present low profile chamber design includes a plurality of asymmetric corrugations running transversely along the length of the chamber. Each transverse corrugation has a wide head section on one side and a narrowing tapered tail section on the opposed side of the chamber. Consequently, the corrugation walls taper and run at an angle relative to the longitudinal axis of the chamber, thereby significantly increasing the longitudinal stiffness of the chamber.

The orientation of each corrugation is opposite that of adjacent corrugations along the length of the chamber and most, if not all, corrugations are of generally uniform size and shape. Accordingly, there is a "corrugation major span-width" defined by the shortest distance between the axial tangential lines of a pair of reversed corrugation head sections at the opposing side bases, and a "corrugation minor span-width" defined by the shortest distance between the axial tangential lines of a pair of reversed corrugation tail sections at the opposing side bases. The ratio of the corrugation minor span-width to the corrugation major span-width correlates to the total span-width of each corrugation and impacts the strength and storage capacity of the leaching chamber. As this ratio increases, chamber strength is reduced but can be compensated for by increased wall thickness and improved shaping of the chamber profile (i.e., more curvature). Storage volume also increases in this case. As this ratio decreases, strength of the chamber increases but storage volume decreases.

With the low-profile chamber design of the present invention, the total span-width of the chamber is similar to that of a standard chamber used for onsite wastewater management systems. However, the height of the chamber is significantly less (Cf. ~8-10 inches low profile height vs. ~12-16 inches standard height). Consequently, the top portion of the chamber is necessarily more flattened with less curvature than standard septic leaching chamber designs, and the corrugation sidewalls are shorter.

With low profile chamber designs, vertical load strength is always a concern due to the inherently flatter top portion of the chamber. A leaching chamber of conventional low-profile design typically includes some form of central interior supporting column to add structural support to the chamber. With the present invention, however, no central columns or supports are required. Instead, the asymmetric corrugations are formed such that the tapered tail end section of each corrugation curves more sharply downward from the flattened top portion to a terminal base point that is significantly inset relative to the wider head sections of adjacent corrugations. In this manner, the tail section of each corrugation is truncated so as to terminate substantially more inward toward the chamber center than the corresponding head section, thus providing greater vertical load support to the central flattened portion of the chamber as a whole.

Importantly, with the forgoing asymmetric chamber construction, the corrugation minor span-width of the chamber is greatly reduced relative to the corrugation major span-width, which remains substantially unchanged. Thus, the ratio of the corrugation minor span-width to the corrugation major span-width is also substantially reduced, which greatly enhances the vertical load capability and overall strength of the low-profile chamber. With this construction, the span-width of each corrugation is shorter, but each corrugation is offset relative to adjacent corrugations, so the overall span-width of the low-profile leaching chamber can remain the same as a standard conventional chamber. Thus, the profile design can be much lower and flatter on the top without losing substantial structural integrity.

The foregoing and additional features and advantages of the present invention will be more readily apparent from the following detailed description. It should be understood, however, that the description and specific examples herein are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
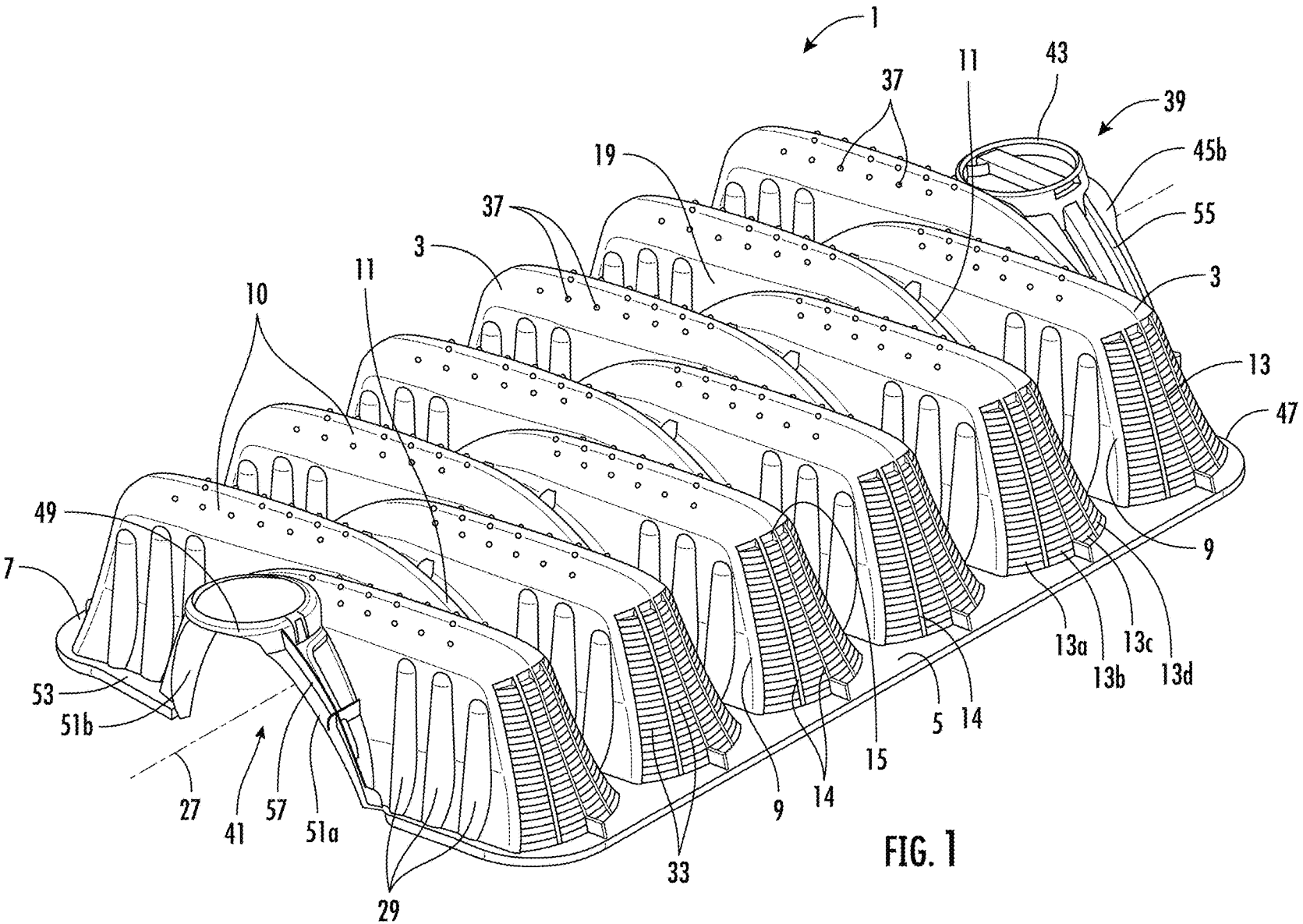
FIG. 1 is a perspective view of my improved low-profile asymmetric chamber design incorporating the principles of my invention, viewed from one end thereof.

The following description is merely exemplary in nature and is not intended to limit the present disclosure, application, or uses. It should be understood that throughout the drawings, corresponding reference numerals indicate like or corresponding parts and features.

Figure 2:
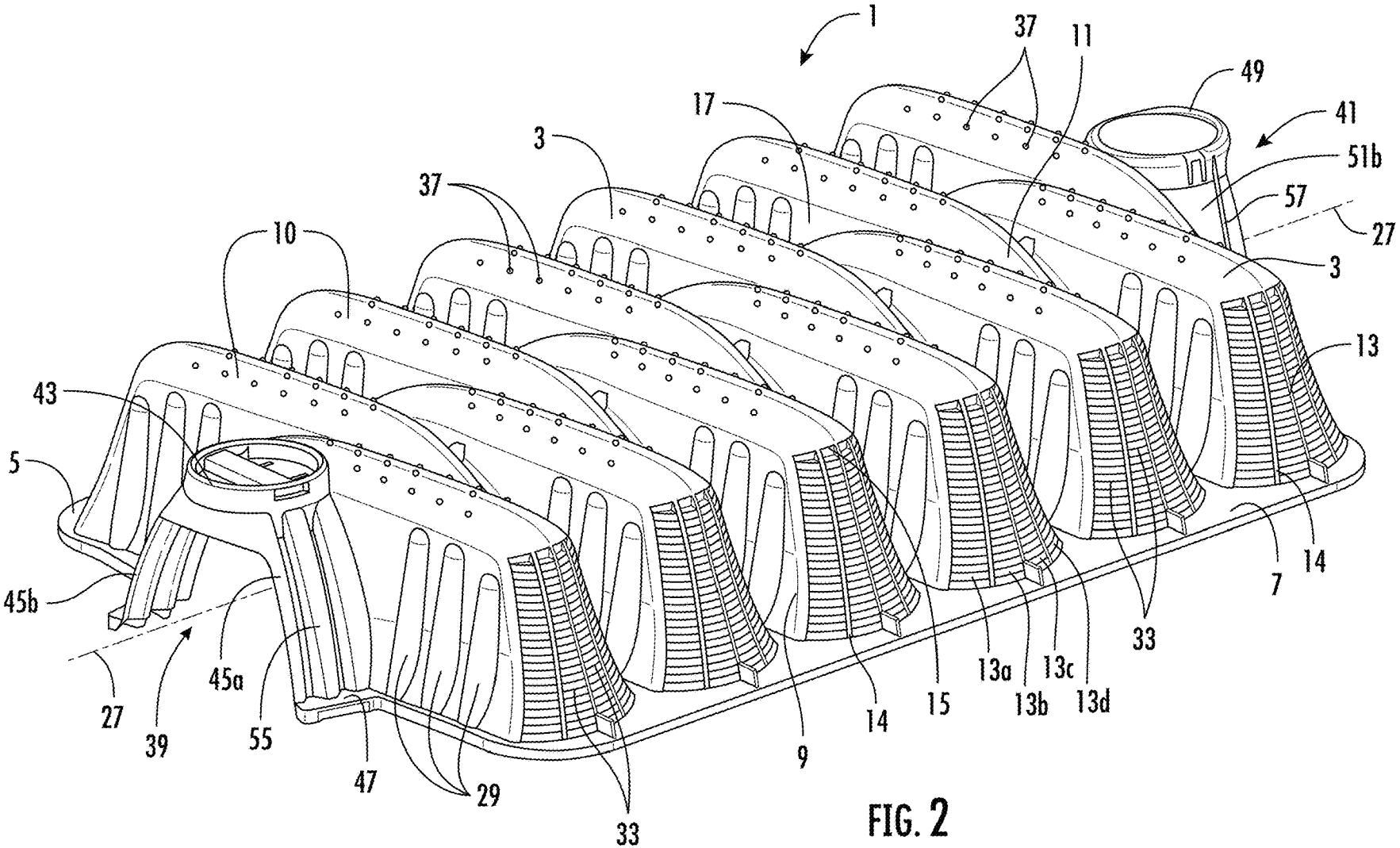
FIG. 2 is a perspective view of the low-profile asymmetric chamber design shown in FIG. 1, viewed from the opposite end thereof.

With reference now to FIGS. 1 and 2 of the drawings, an improved generally arch-shaped leaching chamber 1 constructed in accordance with my invention is disclosed. Chamber 1 has a low-profile design (typically 10 inches in height or less) and an asymmetrical corrugation profile design adapted for use in an onsite wastewater management system. As shown, the main body of chamber 1 includes a series of asymmetric corrugations 3 running along the length thereof. Each corrugation 3 extends transversely relative to a longitudinal axis 27 of chamber 1 from the base 5 on one side of the chamber 1 to the base 7 on the other side of the chamber 1. Each transverse corrugation 3 has a first relatively wide "head" section 9 on one side of the chamber 1 and a second tapering and relatively narrow "tail" section 11 on the opposite side of the chamber 1, the orientation of which alternates along the length of chamber 1.

Figure 6:
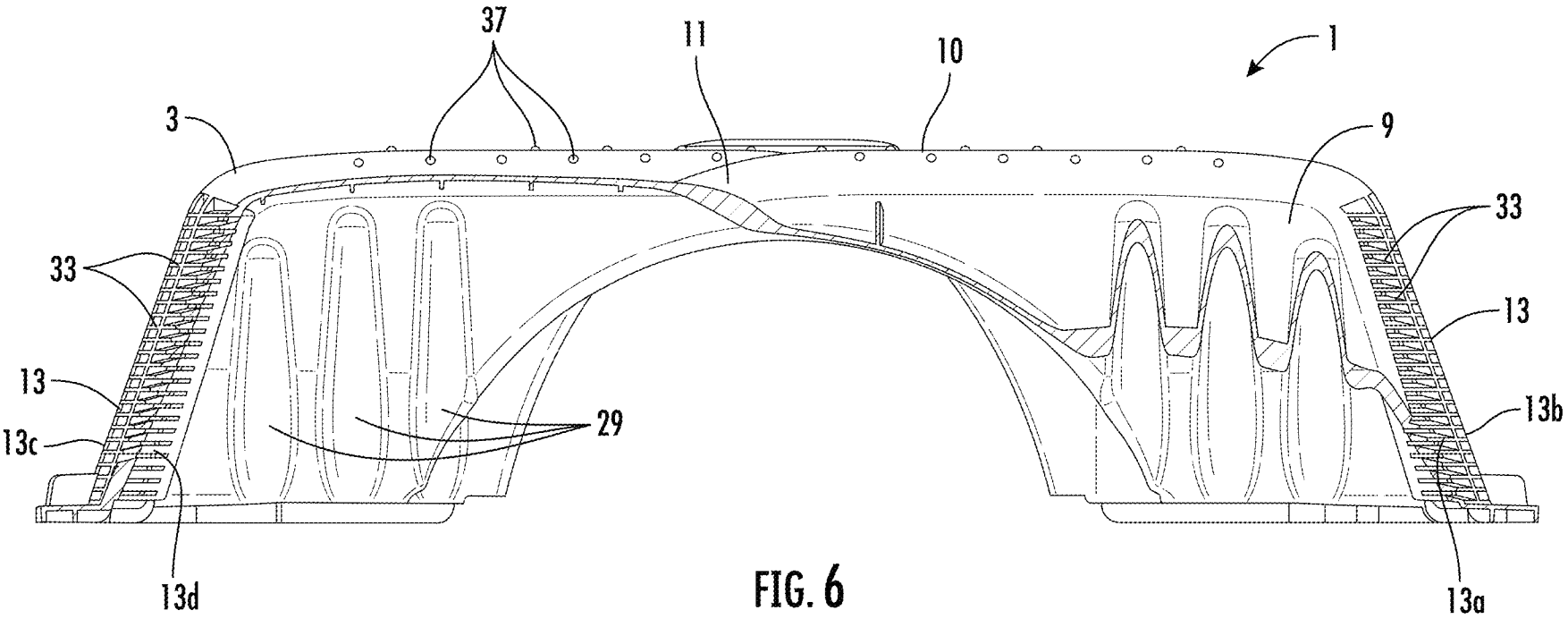
FIG. 6 is a vertical transverse cross-sectional view of the low-profile asymmetric chamber design shown in FIG. 3A, taken along line 6-6 therein.

As shown best in the cross section of FIG. 6 (taken along line 6-6 of FIG. 1), the low-profile chamber 1 is designed to be substantially wider than it is tall (typically about 34 inches wide vs. about 8-10 inches tall). Accordingly, a substantially flat top section 10 extends between and connects the first wider head section 9 and second tapering tail section 11 of each corrugation 3. As shown, the top section 10 maintains a substantially constant elevation extending from the wider head section 9 for at least about 25% of the total span-width of the corrugation 3, where it only slightly diverges downward toward the center of the chamber 1. At a point closely adjacent the central longitudinal axis 27 of chamber 1, the top section 10 transitions into the tapering tail section 11 of the corrugation 3, where it then curves sharply downward toward the opposing side base (5,7).

Figure 3:
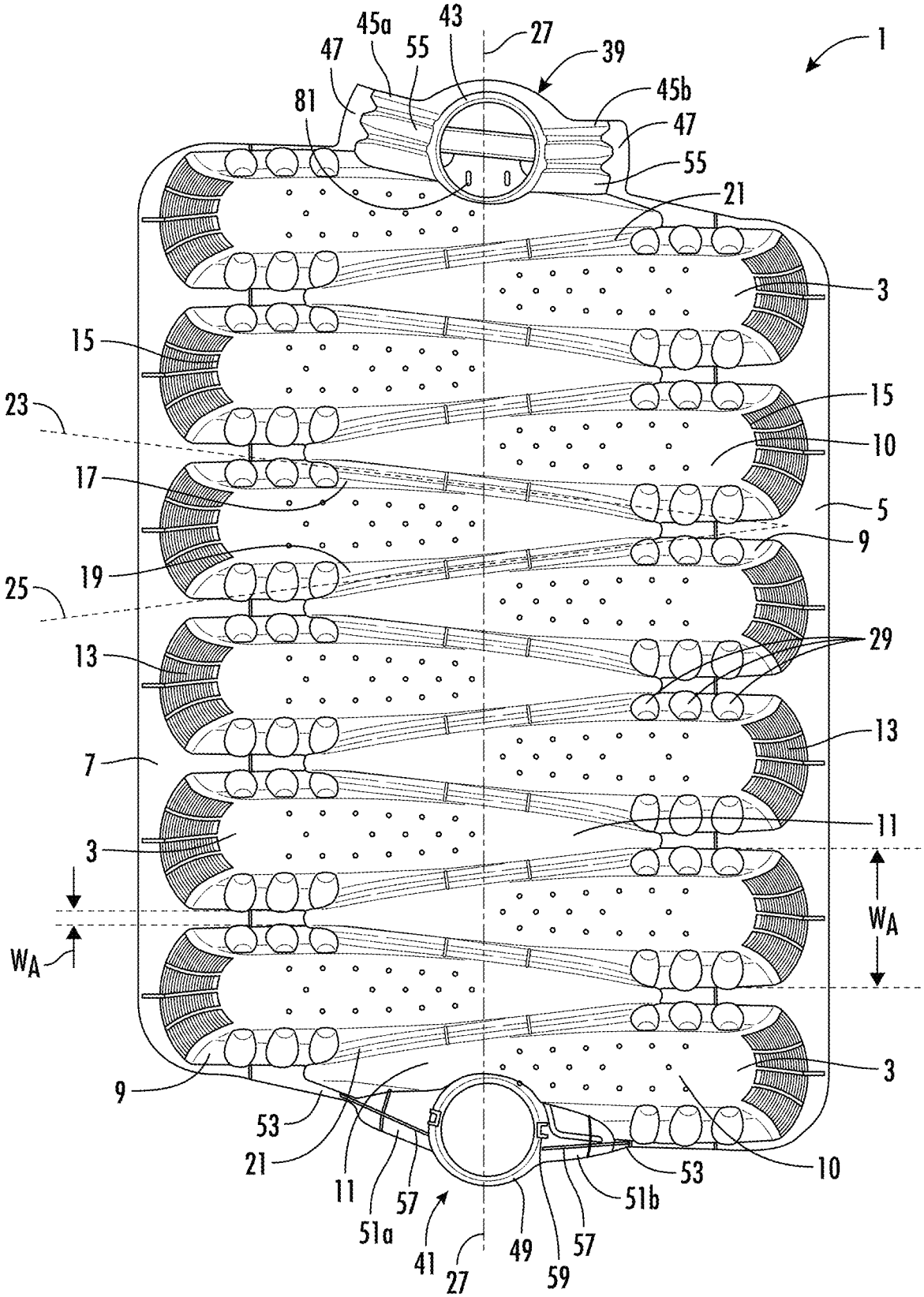
FIG. 3 is a top plan view of the low-profile asymmetric chamber design shown in FIG. 1.
Figure 3A:
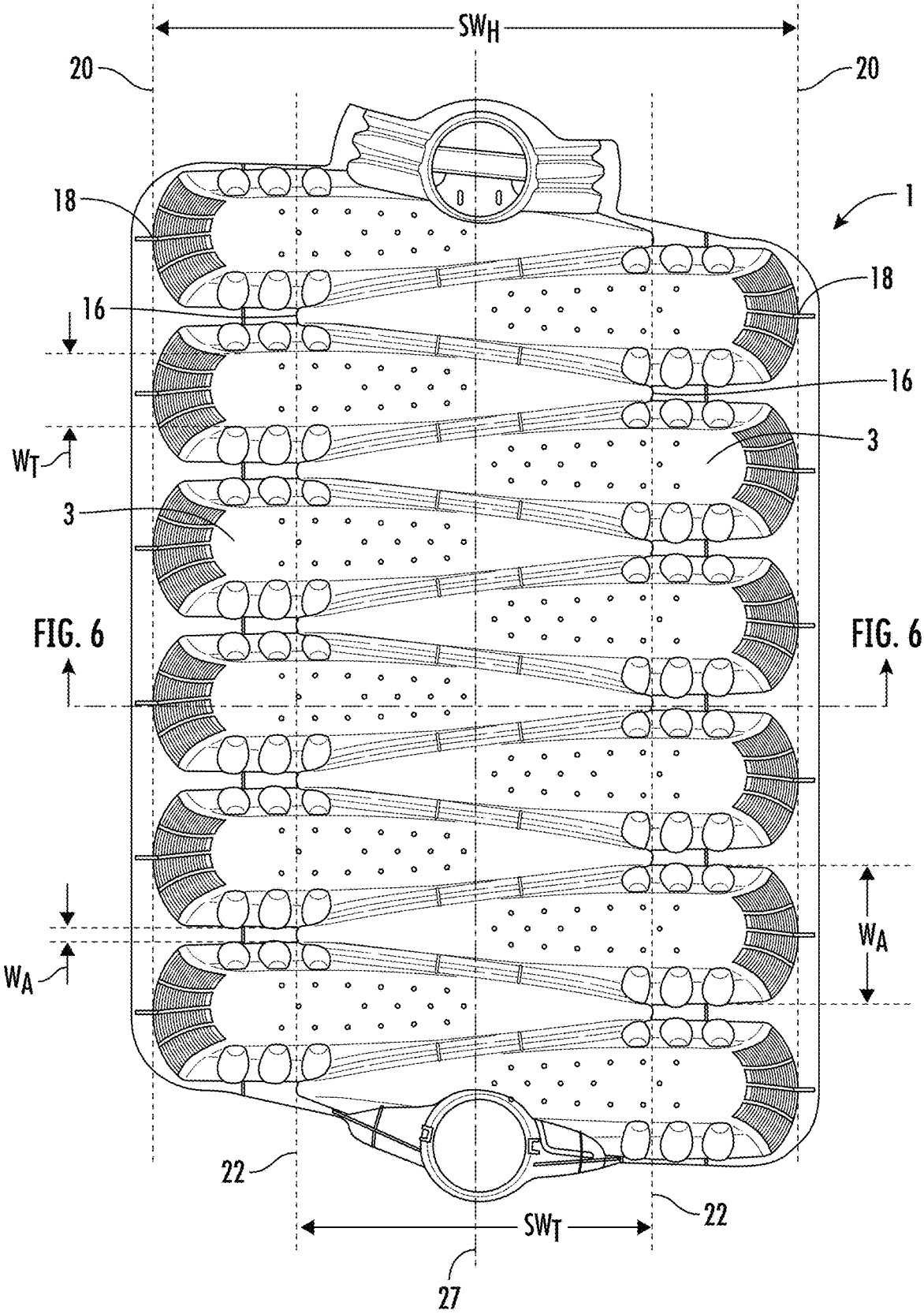
FIG. 3A is a top plan view of the low-profile asymmetric chamber design shown in FIG. 1, showing the axial corrugation tangent lines and dimensions used to calculate the corrugation minimum to maximum span-width ratio and axial width of each corrugation.

As seen in FIG. 3A, the top section 10 of each corrugation 3 also maintains a substantially constant width WT as it extends across the chamber 1 until it transitions into the tail section 11. Upon transition, the tail section 11 of each corrugation 3 begins to taper inwardly in width and curves sharply downward towards the opposite side base of the chamber 1. Here again, this transition from the top section 10 to the tail section 11 can be seen to begin closely adjacent the transverse center of chamber 1, where the corrugation 3 can be seen to then taper progressively inward and downward toward the opposing base of chamber 1.

From FIG. 6, it can also be seen that the transverse arch defined by each corrugation 3 is asymmetric relative to the longitudinal axis 27 of the chamber 1. The head section 9 of each corrugation 3 has a substantially straight sidewall section 13 which extends upwardly and inwardly at a slight angle from one side base (5, 7) of the chamber 1 toward the center thereof. The top section 10 of the corrugation 3 extends at a substantially unform elevation across the chamber to a point closely adjacent the central axis 27 of the chamber 1, where it transitions into the tail section 11. The narrowing tail section 11 then curves downwardly (preferably on a continuous curve) to the opposite side base of chamber 1, where it terminates at a base point 16 substantially inset relative to the outermost base point 18 of the head section 9 of each adjacent corrugation 3. Here again, each successive corrugation 3 alternates orientation along the length of the chamber 1.

With the low-profile chamber design of the present invention, the maximum span-width of chamber 1 is expected to be similar to that of a standard onsite leaching chamber, i.e., typically 22-34 inches wide. However, the height of the chamber is significantly less (Cf., ~8-10 inches low profile height vs. ~12-16 inches standard height). Consequently, as described previously, the top portion of the corrugations 3 are necessarily more flattened with less curvature than with standard septic leaching chamber designs, and the corrugation sidewalls are shorter. With such a design, vertical load strength is a significant concern due to the inherently flatter top portion of the chamber 1. As noted previously, a leaching chamber of conventional low-profile design typically includes some form of central interior supporting column to add structural support to the chamber. With the present invention, however, the substantially inset tail section 11 of corrugations 3 functions to provide enhanced vertical load support to the central flattened portion of the chamber as a whole. Therefore, due particularly to the transverse offsetting nature of the corrugations 3 described above, no central columns or supports are required.

To explain further, with any arch-shaped corrugated leaching chamber, there is typically a relationship between the minimum and maximum span-width of the corrugations which has a correlation to the overall strength and volume capacity of the chamber. The greater the ratio between the minimum and maximum span-width, generally the lower the load strength but greater the storage volume capacity. As this ratio decreases, the chamber becomes stronger, but there is a sacrifice in storage capacity. Of course, material thickness of the chamber walls also influences the chamber strength and, at least with standard arch-shaped chambers, adding more curvature to the chamber profile helps to improve the strength of the chamber. With most standard arch-shaped corrugated chambers, this ratio between the minimum and maximum corrugation span-width typically falls in the range of about 0.85-0.90, or greater.

As shown in FIG. 3A, with the present invention, there is an associated corrugation major span-width ($SW_H$) defined by the shortest transverse distance (i.e., perpendicular) between the axial tangent lines 20 drawn at the base points 18 of opposing corrugation head sections 9. There is also a corrugation minor span-width ($SW_T$) defined by the shortest transverse distance between the axial tangent lines 22 drawn at base points 16 of opposing corrugation tails 11.

The ratio of the corrugation minor span-width $SW_T$ to the corrugation major span-width $SW_H$ (i.e., $SW_T$:$SW_H$) represents a relationship between the span-width of each corrugation 3 and the span-width of the chamber 1 as a whole. A larger $SW_T$:$SW_H$ ratio represents a broader span-width of corrugation 3 relative to the whole of chamber 1. Conversely, a lower $SW_T$:$SW_H$ ratio represents a more limited span-width of corrugation 3 relative to the whole of chamber 1. As will be shown hereafter, this relationship impacts the strength and storage capacity of chamber 1.

As the ratio $SW_T$:$SW_H$ increases, the strength of chamber 1 is reduced due to the increase in relative span-width of the corrugations 3. Although the strength of chamber 1 can be improved with increased wall thickness, adding more curvature to such a low profile chamber is not typically available. On the other hand, a reduction in the $SW_T$:$SW_H$ ratio correlates to a shortening of the relative corrugation span-width, which acts to increase the strength of the chamber 1. In this case, strength is improved but there may be some loss in effective chamber storage volume.

In a preferred embodiment of the present invention, sufficient chamber strength and volume capacity has been found to occur when the $SW_T$:$SW_H$ ratio is in a nominal value range of approximately 0.55±0.10. However, it is contemplated that $SW_T$:$SW_H$ ratios falling within the approximate range of 0.30-0.70 would be acceptable for use in various low-profile applications or configurations, depending on system requirements. For most onsite wastewater storage systems, these chambers 1 must be able to accommodate handling and installation forces as well as earth and vehicle loads such as AASHTO H-10 truckloads.

Importantly, with the foregoing low-profile asymmetric corrugated chamber construction, the corrugation minor span-width $SW_T$ of the chamber 1 is greatly reduced relative to the corrugation major span-width $SW_H$, which remains substantially unchanged from a standard chamber. Thus, the ratio $SW_T$:$SW_H$ of the corrugation minor span-width to the corrugation major span-width is also substantially reduced, which greatly enhances the vertical load capability and overall strength of the low-profile chamber 1. With this construction, the overall span-width of the low-profile leaching chamber 1 can remain the same as a standard chamber, but the profile design can be much lower and flatter on the top without losing substantial structural integrity.

Relating this to the total span-width of each corrugation 3, the foregoing $SW_T$:$SW_H$ ratios indicate that the span-width of each corrugation 3 in the present invention is significantly shorter than that of a standard leaching chamber. Accordingly, as best seen in FIGS. 3 and 3A, in order to maintain a similar overall total chamber span-width, each shorter corrugation 3 is transversely offset relative to an adjacent corrugation 3, such that the tail section 11 thereof terminates at a base point 16 substantially inset relative to that of the head sections 9 of adjacent corrugations 3 (i.e., at base point 18). To obtain the foregoing preferred nominal $SW_T$:$SW_H$ ratio range of approximately 0.55±0.10, it has been determined that the percentage of inset of the tail section 9 relative to the total span-width of each corrugation 3 needs to fall within the approximate range of 21.0%-38.0%. A percentage range of corrugation inset correlating to the broader potential range of acceptable $SW_T$:$SW_H$ ratio values (i.e., 0.30-0.70) is approximately 18.0-54.0%. Of course, altering the corrugation profile of chamber 1 to meet these criteria will depend upon the specific application or system requirements.

As further shown in FIGS. 3 and 3A, with the present asymmetric corrugation design, the ratio of axial corrugation width "WA" of each corrugation 3 from the base of opposing side sections (9, 11) thereof may range from approximately 2:1 to 15:1 (i.e., measured at the tangent point between the valley radius and the base of the corrugation wall located at the base (5, 7) of the chamber (1). Because each corrugation 3 is constructed with a wide head section 9 and a narrow tail section 11, the corrugation walls 17 and 19 which define the crown portion of each corrugation 3, and the valley portions 21 therebetween, extend generally along transverse axes 23 and 25 that are angularly offset from perpendicular relative to the longitudinal axis 27 of chamber 1. The offset axes and non-perpendicular corrugation walls 17 and 19 created by this asymmetric configuration act to substantially reduce the potential for any transverse perpendicular bending moment of the chamber 1, thus increasing the longitudinal axial strength of the chamber. This is a significant improvement over prior art chambers, the corrugations of which generally run parallel to one another in transverse perpendicular orientation relative to the longitudinal axis of the chamber, thus limiting the longitudinal strength of the chamber.

As noted previously, the wider head section 9 of each corrugation 3 of chamber 1 is constructed with a substantially straight sidewall section 13. As shown throughout the drawings, each sidewall section 13 is comprised of a plurality of sidewall sectors 13*a*-13*d* which extend from one base (5, 7) of the chamber 1 to a point 15 adjacent the top of the head section 9. The sidewall sectors 13*a*-13*d* of each corrugation 3 are separated by vertical support members 14 which allow the sidewall sectors 13 to contour the generally curving outer axial confines of the wider head section 9 of the corrugation. However, as best seen in FIG. 6, vertically, each sidewall sector 13*a*-13*d* is substantially straight, and extends from its associated base member (5, 7) to point 15 adjacent the top of the head section 9. Of course, although sidewall section 13 is depicted in the drawings as being comprised of four separate sectors 13*a*-13*d*, it is contemplated that more or less sidewall sectors could be utilized without departing from the invention herein.

Incorporating the wide straight sidewalls sections 13 effectively increases the vertical load capability and stiffness to weight ratio of the chamber 1. Similarly, the offset nature of each corrugation 3 and significantly lower $SW_T$:$SW_H$ ratio of the corrugation minor span-width to the corrugation major span-width of the corrugations 3 of the low-profile chamber 1 provides further superior load distribution capability. Together, these features allow the low-profile chamber 1 to maintain the same width as a standard arch-shaped leaching chamber without substantially jeopardizing vertical load strength or requiring added supporting ribs or columns. Furthermore, as seen best in FIGS. 3 and 4, the narrow valley portions 21 extending between each corrugation 3, in effect, create a series of internal strengthening members which help to further enhance the stiffness to weight ratio of the chamber 1.

In one contemplated embodiment, a series of one or more vertically extending sub-corrugations 29 may be formed on the opposing corrugation walls 17 and 19 of each corrugation 3, preferably adjacent the wider head section 9 thereof. As shown best in FIGS. 1, 2 and 6, these sub-corrugations 29 preferably extend vertically at least part way up the corrugation walls 17 and 19 of each corrugation 3 from a point adjacent an associated base member (5, 7) of chamber 1 to a point adjacent the top section 10 of each corrugation 3. Sub-corrugations 29 serve to provide additional vertical load capability and strength to each corrugation 3, particularly in the area of the wider head section 9.

Figure 4:
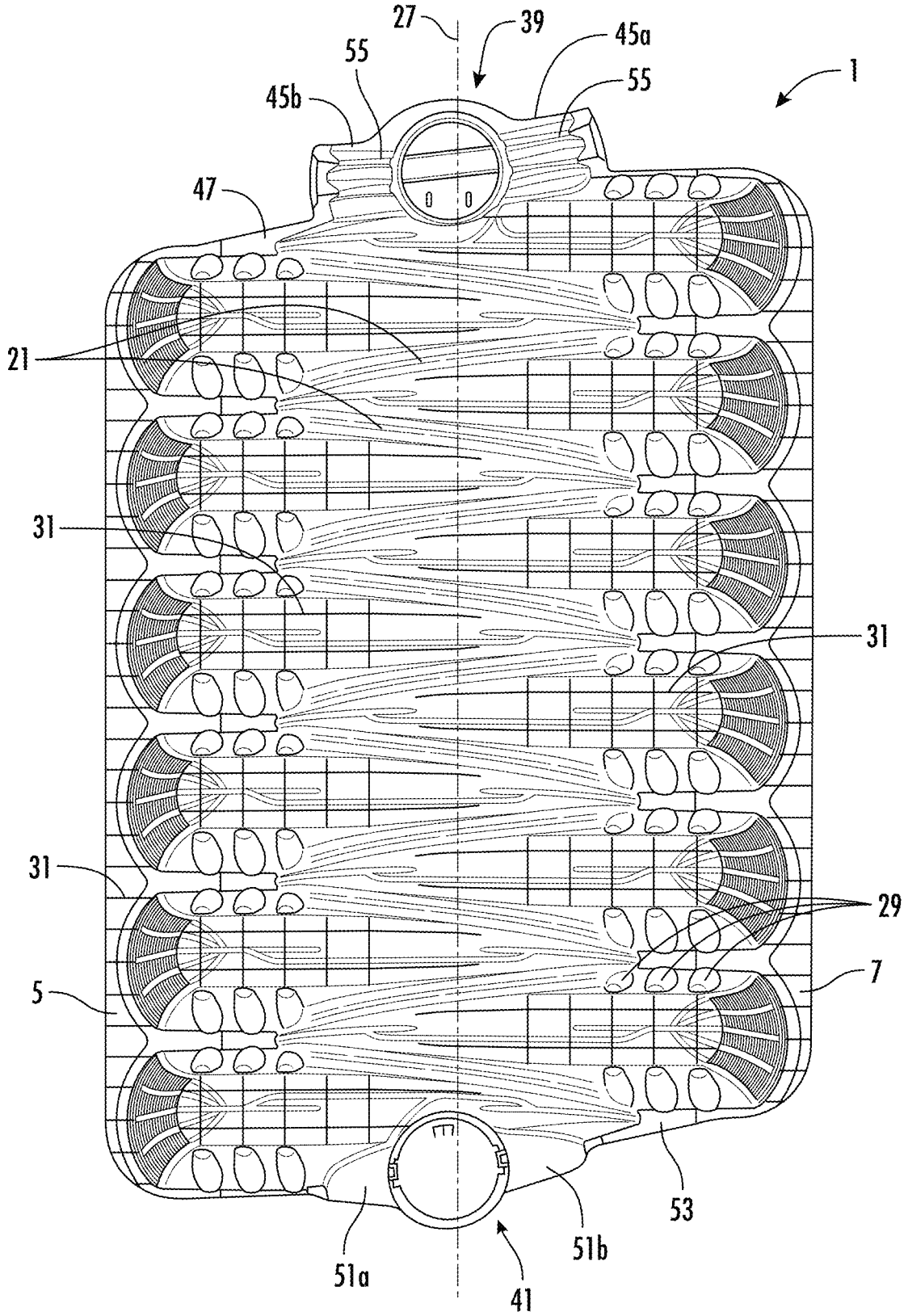
FIG. 4 is a bottom plan view of the low-profile asymmetric chamber design shown in FIG. 1.
Figure 5:
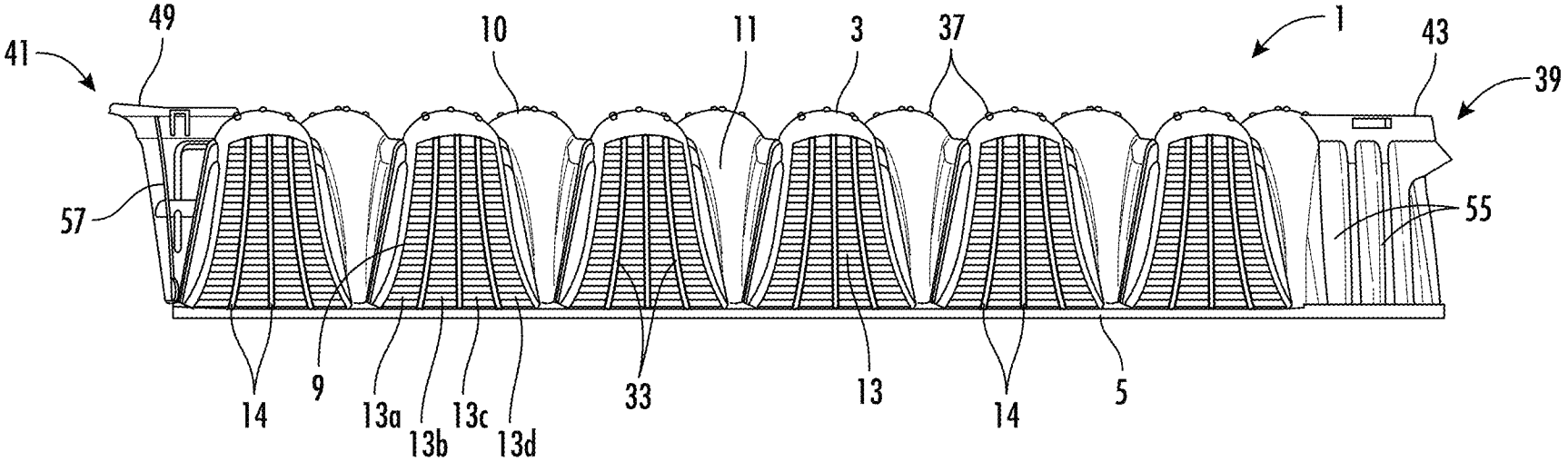
FIG. 5 is a right-side elevation view of the low-profile asymmetric chamber design shown in FIG. 1.

With reference being had to FIG. 4, it is seen that an additional latticework of supporting rib structures 31 may also be formed on the underside of chamber 1, including the underside surface of the corrugations 3, the head sections 9, and the bases 5 and 7 which extend outward from the chamber 1. It is worth noting that the ribs 31 are incorporated primarily to accommodate localized strength requirements rather than improving the strength of the overall arch, i.e., for preventing localized buckling rather than contribution of overall arch stiffness. This is especially important for lower quality installation conditions. Without the present design features of chamber 1, the ribs 31 would actually need to be much more substantial. Nevertheless, such an added latticework of supporting ribs 31 can function to provide additional overall strength and support to the chamber 1 as well.

As shown throughout FIGS. 1-6, at least a portion of the large straight sidewalls 13 of each corrugation 3 include a plurality of vertically spaced elongated horizontal louvered slots 33 which extend from the interior of the chamber 1 through to the exterior. As seen best in FIG. 5, with this asymmetric corrugation design, the spacing between each adjacent large corrugation head section 9, and the slotted sidewall sections 13 thereof, is minimized. This effectively maximizes the area for effluent transfer through the chamber sidewalls and into the surrounding soil.

As seen best in FIGS. 1-3A and FIG. 6, on at least a portion of the top surface of each corrugation 3, a plurality of optional traction nubs 37 may be incorporated to help provide better footing and traction for installers and others during installation of the chambers 1. Such traction nubs 37 may comprise numerous small pyramids or cone-like shaped upstanding projections with upwardly facing apexes intended to engage the footwear of installers and others who traverse across the chambers 1 during installation. Of course, other configurations and differently shaped traction nub features are conceivable which would help to enhance traction atop such chambers 1 without departing form the invention herein.

While the foregoing discussions and drawings disclose a preferred embodiment where each of the corrugations 3 of the chamber 1 are offset relative to adjacent corrugations 3, it is contemplated that other configurations may be possible where certain corrugations are offset relative to one another, and others are not. Although vertical load strength may be somewhat compromised under such circumstances, storage volume may increase. It is contemplated that in certain applications this could be considered acceptable.

As further shown throughout the drawings, chamber 1 is constructed with a first integral end connector 39 on one end of the chamber 1 and a second integral end connector 41 formed on the opposite end of the chamber 1. End connectors 39 and 41 are formed with a flexible lock and catch latching system which permits angular adjustment of adjoining chambers 1 and prevents vertical movement therebetween when secured together in the field.

Figure 7:
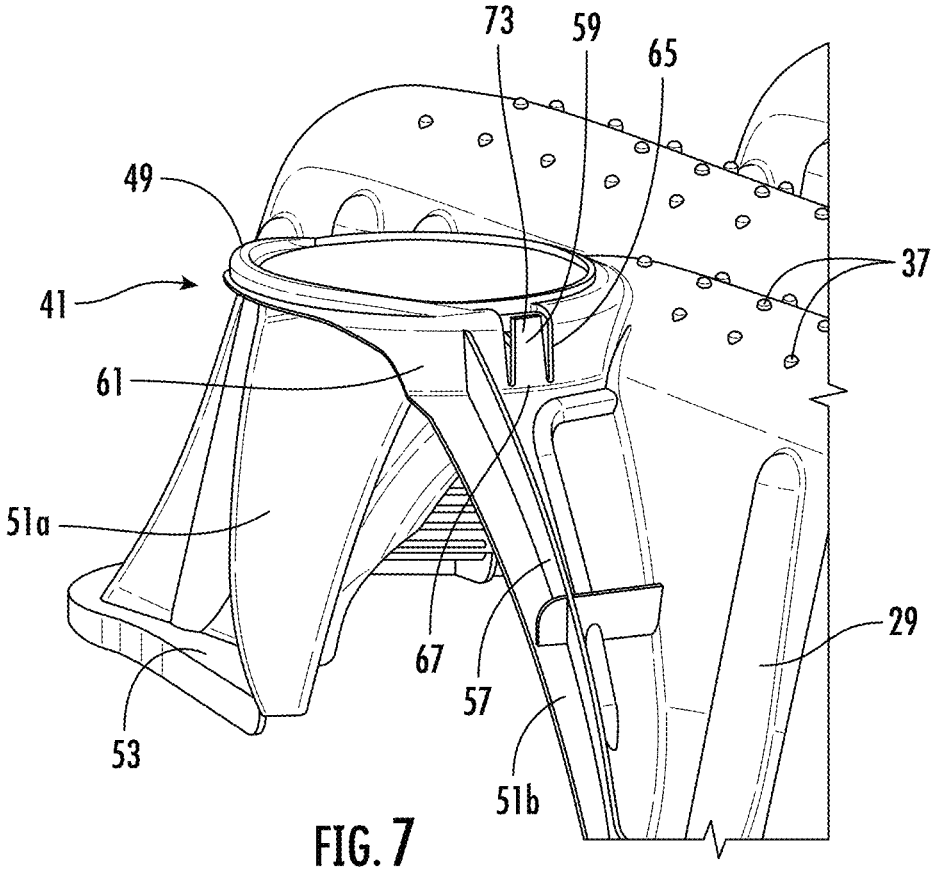
FIG. 7 is a blown-up top perspective detail view of the overlaying end connector of the low-profile asymmetric chamber design shown in FIG. 1, showing the construction of a snap-lock latching element formed therein.
Figure 8:
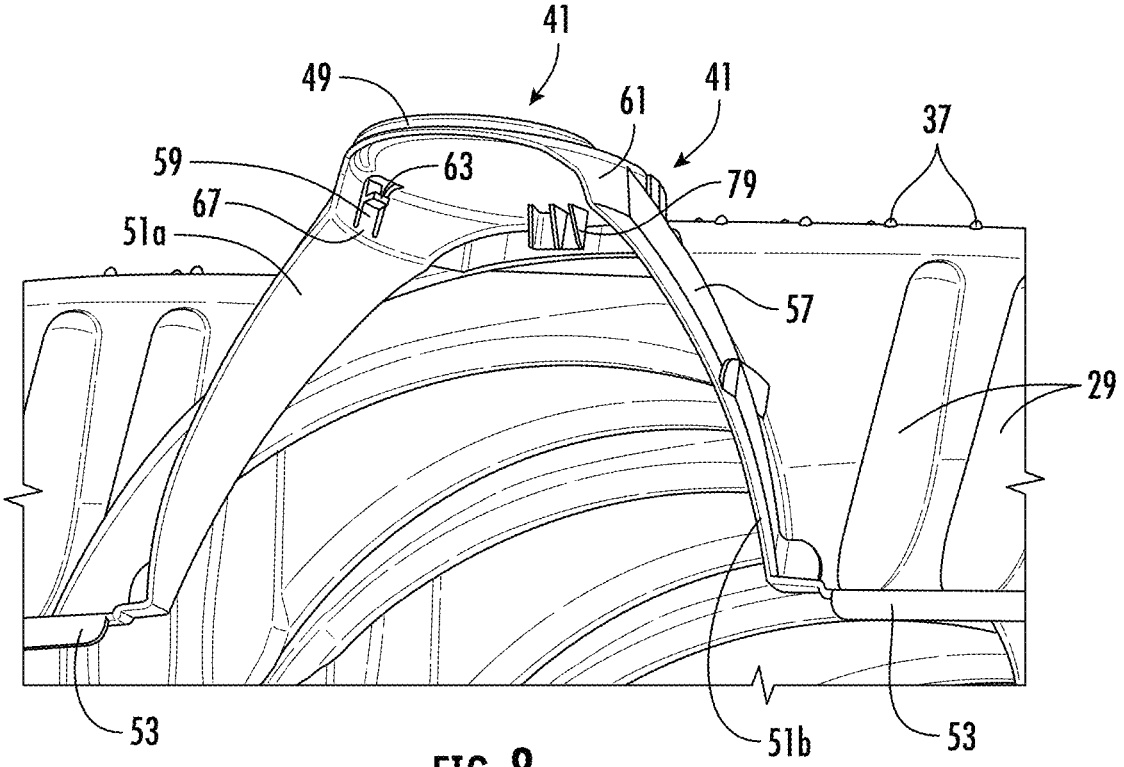
FIG. 8 is a blown-up bottom perspective detail view of the overlaying end connector shown in FIG. 7.
Figure 9:
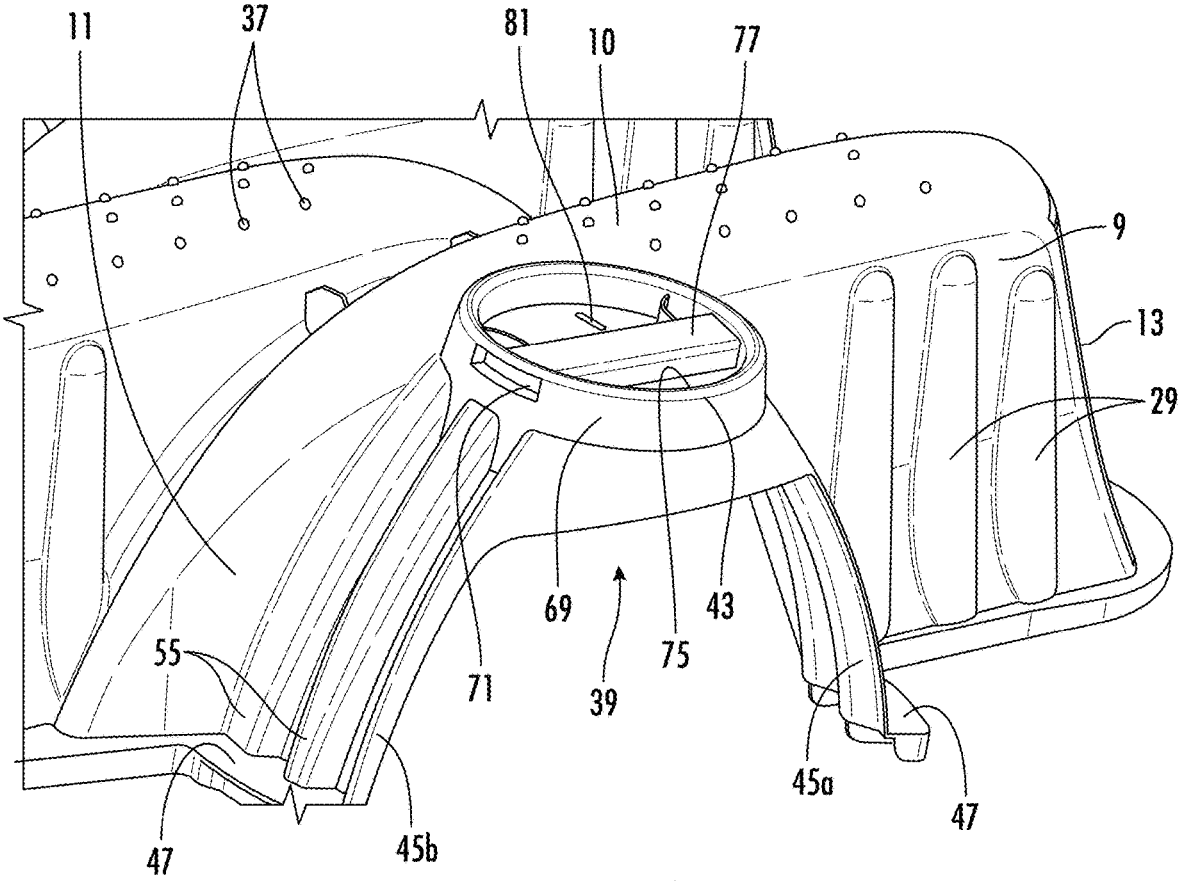
FIG. 9 is a blown-up top perspective detail view of the opposite underlying end connector of the low-profile asymmetric chamber design shown in FIG. 1, showing the mating catch mechanism for the snap-lock latching element of the overlying end connector.

As best seen in FIGS. 7-9, each end connector 39 and 41 has an opening communicating with the interior of the main body of the chamber 1. The first end connector 39 (FIG. 9) includes a circular riser section 43 at its top and a pair of sidewall sections 45*a* and 45*b* extending downward therefrom to a base 47 which is substantially coplanar with the chamber side base members 5 and 7. The second end connector 41 (FIGS. 7-8) is similarly comprised of an upper circular riser section 49 with descending sidewall sections 51*a* and 51*b* which extend downward to a base 53 that is also substantially coplanar with the chamber side base members 5 and 7.

End connectors 39 and 41 are designed to compliantly mate with one another to provide angular horizontal movement of one chamber 1 relative to another chamber 1 of like configuration. As shown best in FIGS. 7-9, the second end connector 41 is designed in such manner as to overlap the first end connector 39. The circular riser section 49 of end connector 41 is configured to compliantly seat over the top of circular riser section 43 of end connector 39, thereby facilitating pivotal movement between adjoining chambers 1. Similarly, sidewall segments 51*a*, 51*b* of the second end connector 41 are configured to overlay sidewall segments 45*a*, 45*b* of the first end connector 39 in such manner as to facilitate overlapping angular movement therebetween.

As shown best in FIG. 9, the outer surface of each sidewall segments 45*a*, 45*b* of the first end connector 39 may also be configured to include one or more elongated strengthening ribs 55 extending vertically between the circular riser 43 and base section 47 thereof. Also, as shown in FIGS. 7 and 8, one or more additional vertically extending strengthening ribs 57 may extend along the exterior surface of sidewall segments 51*a*, 51*b* for added support and strength. These strengthening ribs 55, 57 help to add further support and vertical load strength to the mating end connector sections 39 and 41.

A positive locking engagement can be achieved between the first and second end connectors 39 and 41 via a built-in snap locking feature incorporated therein. As shown in FIGS. 7 and 8, at least one flexible snap locking member 59 may be formed in the tapered sidewall 61 of the circular riser section 49 of the overlying second end connector 41. In one embodiment shown, a pair of locking members 59 are incorporated into end connector 41, substantially diametrically opposed from one another. Each snap locking member 59 is designed to extend upward from a lower perimeter portion of the tapered sidewall 61 of the circular riser section 49 and includes a radially inward protruding latch element 63. This locking member 59 is provided with a relief in the form of an opening 65 extending around its upper end and along each of its sides, thus creating a cantilever along its bottom supporting edge 67. This imparts radial flexibility to the locking member 59 relative to the circular riser section 49 to help facilitate joinder with an underlying coupling section 39 of another chamber 1.

As seen in FIG. 9, the underlying first end connector 39 also includes a tapered sidewall 69 which is designed to slidably receive in guided inter-engagement sidewall 61 of a second overlying end connector 41 of an adjoining chamber 1. As shown, an upper edge portion of the tapered sidewall 69 of riser section 43 on the first end connector 39 is formed with at least one elongated peripheral opening 71. Opening 71 functions as a catch for an associated inwardly protruding latch 63 of a flexible locking member 59 formed in the overlaying second end connector 41. Locking member 59 is positioned to align with catch opening 71 and engage the same in locking relation when two like chambers 1 are fitted together end-to-end, thereby restricting vertical movement between the adjoining end connectors. The locking member 59 is permitted to slide laterally within the elongated peripheral slot 71 so as not to obstruct horizontal angular movement of one chamber 1 relative to another when latched together. Locking member 59 is also constructed with a small outward extending flange 73 at its top edge which may be gripped to release locking member 59 from locking relation with catch opening 71 in the event it is necessary or desired for any reason to disconnect a pair of adjoined chambers 1.

As shown best in FIG. 9, a hollow or recess 75 is formed in the top of the first end connector 39. Recess 75 is peripherally bounded by the riser sidewall 69 and a supporting channel support member 77 which extends across the top of riser 43 between opposed peripheral openings 71. Recess 75 in the first end connector 39 is adapted to receive in guiding relation a tapered flange 79 (shown in FIG. 8) which protrudes downwardly from the underside of the second overlying end connector 41. Flange 79 is positioned and adapted to mate with recess 75 in order to help facilitate proper axial positioning of adjoining chambers 1 and to resist axial dislodgement thereof. Upon angular adjustment of two adjoining chambers 1, it will be appreciated that the latch 63 of locking member 59 is permitted to slide angularly within the elongated peripheral opening 71. Also, the flange element 79 is allowed to move angularly along a general horizontal plane within recess 75. In this manner, adjoining chambers 1 are permitted to rotate slightly relative to one another about the center of the mating end connectors 39 and 41. The joined chambers 1 are allowed to freely pivot to a degree left or right relative to one another, e.g. typically 3 to 10 degrees left and right.

As further shown in FIGS. 3 and 9, the riser section 43 of the underlying first end connector 39 may also be formed with openings 81 in an upper surface thereof through which a conventional dosing pipe hanging means, such as a plastic cable tie (not shown), may be received to secure a dosing pipe (not shown) to the upper interior portion of chamber 1. The tie may be routed down through one opening 81, around the dosing pipe, and back through another opening 81 for connection on top of the riser 43. The locking head of the cable tie will seat within the hollow formed in the top of the riser section 43 so as not to interfere with rotational movement between joined end connectors.

With the forgoing low-profile asymmetric chamber construction, the span-width of each corrugation is shorter, but each corrugation is offset relative to adjacent corrugations, so the overall span-width of the low-profile leaching chamber can remain the same as a standard conventional chamber. Accordingly, the corrugation minor span-width of the chamber is greatly reduced relative to the corrugation major span-width, which remains substantially unchanged. As a result, the ratio of the corrugation minor span-width to the corrugation major span-width is also substantially reduced, which greatly enhances the vertical load capability and overall strength of the low-profile chamber. Thus, the profile design can be much lower and flatter on the top without losing substantial structural integrity.

Furthermore, the large slotted straight sidewall sections and arched corrugations allows for chambers having a greater span-width and a larger, substantially flat crown area, thus increasing the available footprint on the chamber crown area without sacrificing load strength. The low-profile asymmetric corrugation profile also significantly increases the longitudinal stiffness of the chamber. Still further, it provides a chamber with sidewalls having an increased stiffness to weight ratio and maximizes the louver slot area for greater effluent to soil contact area. With the added benefit of angularly adjustable interlocking end connectors and broad studded crown surfaces offering enhanced traction, maximum flexibility and ease of use in the field is obtained.

The disclosure herein is intended to be merely exemplary in nature and, thus, variations that do not depart from the gist of the disclosure are intended to be within the scope of the disclosure. Such variations are not to be regarded as a departure from the spirit and scope of the disclosure, which comprises the matter shown and described herein, and set forth in the appended claims.

The invention claimed is:

1. A leaching chamber for use with an onsite wastewater management system, comprising:

(a) a chamber body with a central axis and a generally arch-shaped cross section extending between opposite side bases thereof, said chamber body including a plurality of corrugations extending transversely between said opposite side bases;

(b) each of said corrugations having a first transverse side section with a substantially straight sidewall extending upwardly from one of said side bases to a substantially flat top portion, and a second transverse side section with a curved sidewall extending from said top portion downward to said side base on said opposite side of said chamber body;

(c) said first side section and said second side section of each of said corrugations being reversed in orientation relative to that of an adjacent said corrugation;

(d) said chamber body having a corrugation major span-width representing the shortest distance between axial tangential lines of a pair of reversed said first side sections at opposing said side bases;

(e) said chamber body having a corrugation minor span-width representing the shortest distance between axial tangential lines of a pair of reversed said second side sections at opposing said side bases; and (f) a corrugation span-width ratio between said corrugation minor span-width and said corrugation major span-width being within the range of approximately 0.30-0.70.

2. The leaching chamber set forth in claim 1, wherein said ratio of corrugation span-width is within a range of approximately 0.55±0.10.

3. The leaching chamber set forth in claim 1, wherein an outermost transverse point of said second side section of each said corrugation is inset from an outermost transverse point of said first sidewall section of said adjacent corrugation a distance falling within an approximate range of 21.0-38.0 percent of a largest transverse dimension of said corrugation.

4. The leaching chamber set forth in claim 1, wherein the axial width of said first side section of each of said corrugations is substantially greater adjacent said side base from which it extends than the axial width of said second side section adjacent said opposite side base.

5. The leaching chamber set forth in claim 4, wherein a ratio of taper from a widest point of said corrugation to a narrowest point of said corrugation is in an approximate range of 2:1 to 15:1.

6. The leaching chamber set forth in claim 1, wherein said substantially flat top portion of each of said corrugations transitions to said second side section thereof at a point closely adjacent a central longitudinal axis of said chamber body.

7. The leaching chamber set forth in claim 1, wherein said substantially straight sidewall section of each of said corrugations includes a plurality of horizontal slots extending therethrough from an exterior of said chamber body to an interior thereof to allow wastewater to flow through said chamber body.

8. The leaching chamber set forth in claim 1, wherein each of said corrugations is transversely offset relative to said central axis.

9. The leaching chamber set forth in claim 1, wherein said second side section of each of said corrugations is continuously curved from said top section of said corrugation to said side base where said second side section terminates.

10. The leaching chamber set forth in claim 1, wherein each of said corrugations tapers in width from said top section to a narrowest point adjacent said side base where said second side section terminates.

11. The leaching chamber set forth in claim 1, wherein a maximum height of said chamber body is about one-third or less a maximum width of said chamber body.

12. The leaching chamber set forth in claim 1, wherein a corrugation wall section connecting adjacent said corrugations includes at least one vertically extending sub-corrugation positioned adjacent to said substantially straight sidewall section thereof.

13. A leaching chamber for use with an onsite wastewater management system, comprising:

(a) an elongated generally arch-shaped chamber body having a plurality of corrugations positioned along the length thereof, said corrugations extending transversely relative to a central longitudinal axis of said chamber body between a base on a first side of said chamber body and a base on an opposite second side of said chamber body;

(b) a first corrugation of said plurality of corrugations having a substantially straight sidewall section extending upwardly from said base on said first side of said chamber body to a substantially flat top portion thereof, and a curved sidewall section extending from said top portion downward to said base on said opposite second side of said chamber body;

(c) a second corrugation of said plurality of corrugations adjacent to said first corrugation having a substantially straight sidewall section extending upwardly from said base on said second side of said chamber body to a substantially flat top portion thereof, and a curved sidewall section extending from said top portion downward to said base on said first side of said chamber body;

(d) said substantially straight sidewall section of said first corrugation and said second corrugation including a plurality of substantially horizontal slots extending therethrough from an exterior of said chamber body to an interior thereof to allow wastewater to flow through said chamber body; and (e) said flat top portion of said first corrugation and said second corrugation transitioning to said curved sidewall section thereof at a point closely adjacent said central longitudinal axis of said chamber body.

14. The leaching chamber set forth in claim 13, further comprising:

(f) said chamber body having a corrugation major span-width measured perpendicular to said central longitudinal axis between an outermost transverse point of said straight sidewall section of said first corrugation and an outermost transverse point of said straight sidewall section of said second corrugation;

(g) said chamber body having a corrugation minor span-width measured perpendicular to said central longitudinal axis between an outermost transverse point of said curved sidewall section of said first corrugation and an outermost transverse point of said curved sidewall section of said second corrugation; and (h) a ratio of said corrugation minor span-width to said corrugation major span-width being within the approximate range of 0.30-0.70.

15. The leaching chamber set forth in claim 14, wherein said ratio of said corrugation minor span-width to said corrugation major span-width is within a range of approximately 0.55±0.10.

16. The leaching chamber set forth in claim 13, wherein a center of said first corrugation and a center of said second corrugation is transversely offset relative to said central longitudinal axis of said chamber.

17. The leaching chamber set forth in claim 13, wherein said curved section of said first corrugation and said second corrugation taper in width from said top portion thereof to said base to which it extends.

18. The leaching chamber set forth in claim 13, wherein an outermost transverse point of said curved sidewall section of said second corrugation is inset from an outermost transverse point of said straight sidewall section of said first corrugation a distance falling within an approximate range of 21.0-38.0 percent of a largest total transverse dimension of said second corrugation.

19. The leaching chamber set forth in claim 13, wherein said top portion of said first corrugation and said second corrugation include a plurality of traction nubs formed on an outer surface thereof.

20. The leaching chamber set forth in claim 13, wherein a corrugation wall section connecting said first corrugation and said second corrugation includes at least one vertically extending sub-corrugation.

21. The leaching chamber set forth in claim 13, wherein said chamber body includes a first end coupling section and a second end coupling section and said first end coupling section is constructed to mate with and be angularly adjustable relative to said second end coupling section of a chamber of like construction.

22. A leaching chamber for use with an onsite wastewater management system, comprising:

(a) an elongated generally arch-shaped chamber body having a plurality of corrugations positioned along the length thereof, said corrugations extending transversely relative to a central longitudinal axis of said chamber body between a base on a first side of said chamber body and a base on an opposite second side of said chamber body;

(b) a first corrugation of said plurality of corrugations having a substantially straight sidewall section extending upwardly from said base on said first side of said chamber body to a substantially flat horizontal top portion thereof, and a tapering sidewall section extending from said top portion downward to said base on said opposite second side of said chamber body;

(c) a second corrugation of said plurality of corrugations adjacent to said first corrugation having a substantially straight sidewall section extending upwardly from said base on said second side of said chamber body to a substantially flat horizontal top portion thereof, and a tapering sidewall section extending from said top portion downward to said base on said first side of said chamber body;

(d) said substantially straight sidewall section of said first corrugation and said second corrugation including a plurality of substantially horizontal slots extending therethrough from an exterior of said chamber body to an interior thereof to allow wastewater to flow through said chamber body;

(e) a maximum height of said chamber body being about one-third or less a maximum width of said chamber body; and (f) an outermost transverse point of said tapering sidewall section of said second corrugation being inset from an outermost transverse point of said straight sidewall section of said first corrugation a distance falling within an approximate range of 18.0-54.0 percent of a largest total transverse dimension of said second corrugation.

* * * * *